US005967229A

United States Patent [19]

Basso

[11] Patent Number: 5,967,229

[45] Date of Patent: Oct. 19, 1999

[54] DEVICE FOR PLUGGING HORIZONTAL OR VERTICAL WELLS IN OIL OR SIMILAR DRILLINGS

[76] Inventor: Antonio Carlos Basso, Corrientes 623, 5800 Rio Cuarto, Cordoba, Argentina

[21] Appl. No.: 08/878,413

[22] Filed: Jun. 18, 1997

Related U.S. Application Data

[63] Continuation-in-part of application No. 08/574,114, Dec. 18, 1995.

[30] Foreign Application Priority Data

Dec. 19, 1994 [AR] Argentina ..... 330.431
Nov. 1, 1995 [AR] Argentina ..... 334.069

[51] Int. Cl.[6] ..... E21B 33/127

[52] U.S. Cl. ..... 166/187; 166/192

[58] Field of Search ..... 166/135, 187, 166/192, 202, 387

[56] References Cited

U.S. PATENT DOCUMENTS 4,962,812 10/1990 Berzin ..... 166/187

*Primary Examiner*—William Neuder
*Attorney, Agent, or Firm*—Gottlieb, Rackman & Reisman, P.C.

[57] ABSTRACT

A device for plugging horizontal or vertical wells in oil or similar drillings includes a fluid-inflatable elastic packing element, which readily expands by the introduction of fluid therein, to fill an interior portion of the well to seal the well.

43 Claims, 5 Drawing Sheets

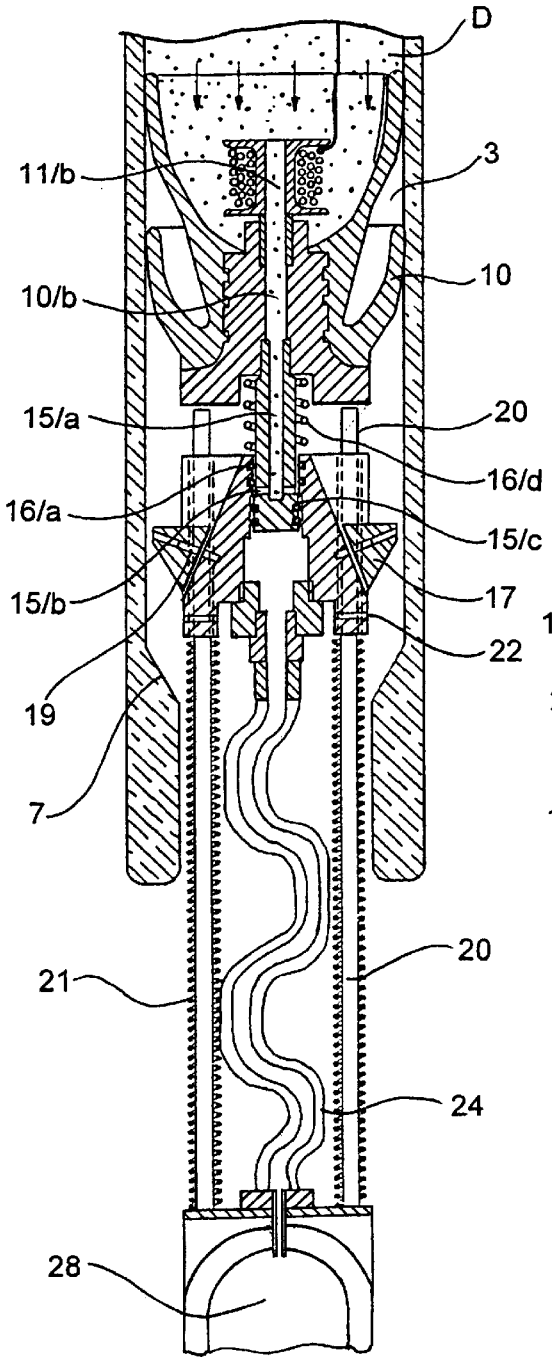
FIG. 8-A
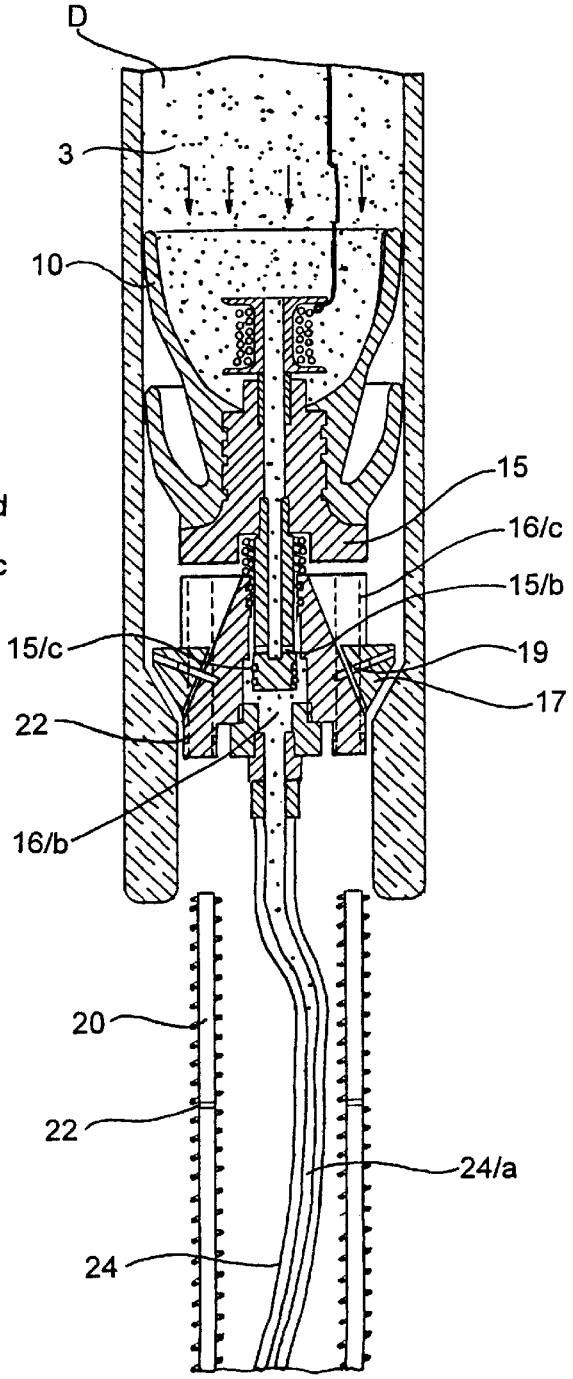
FIG. 8-B

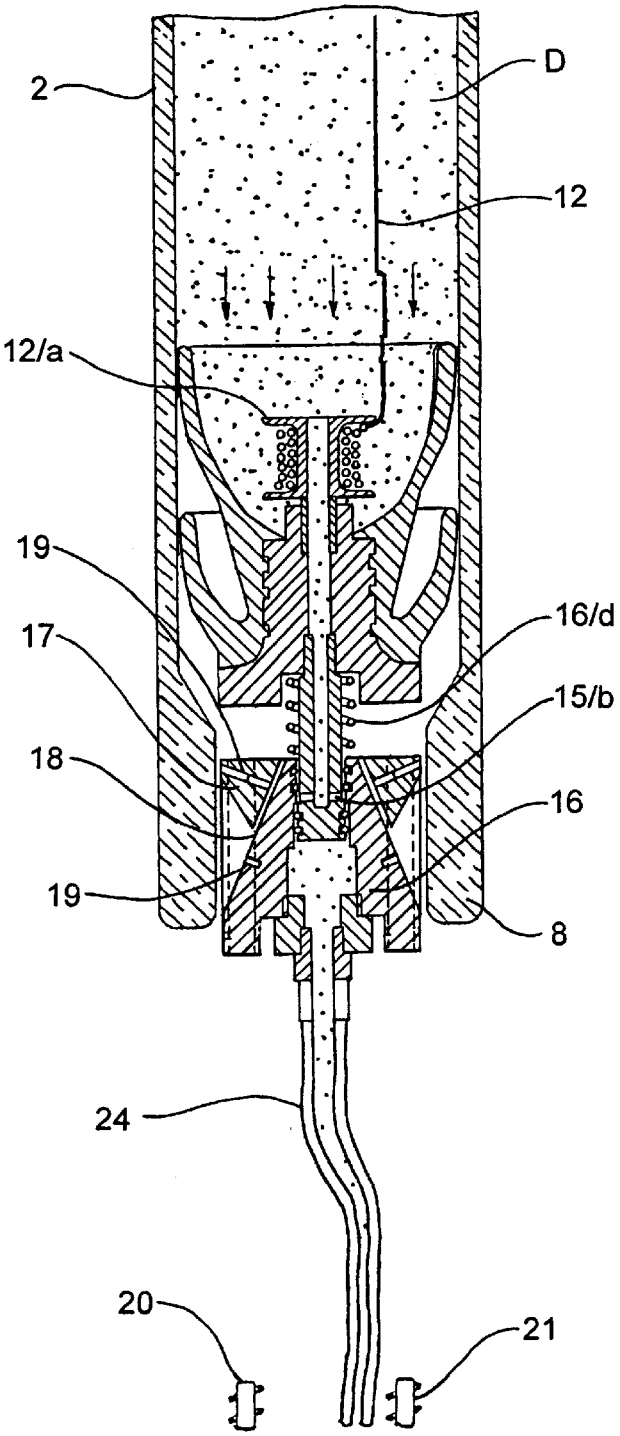
FIG. 8-C
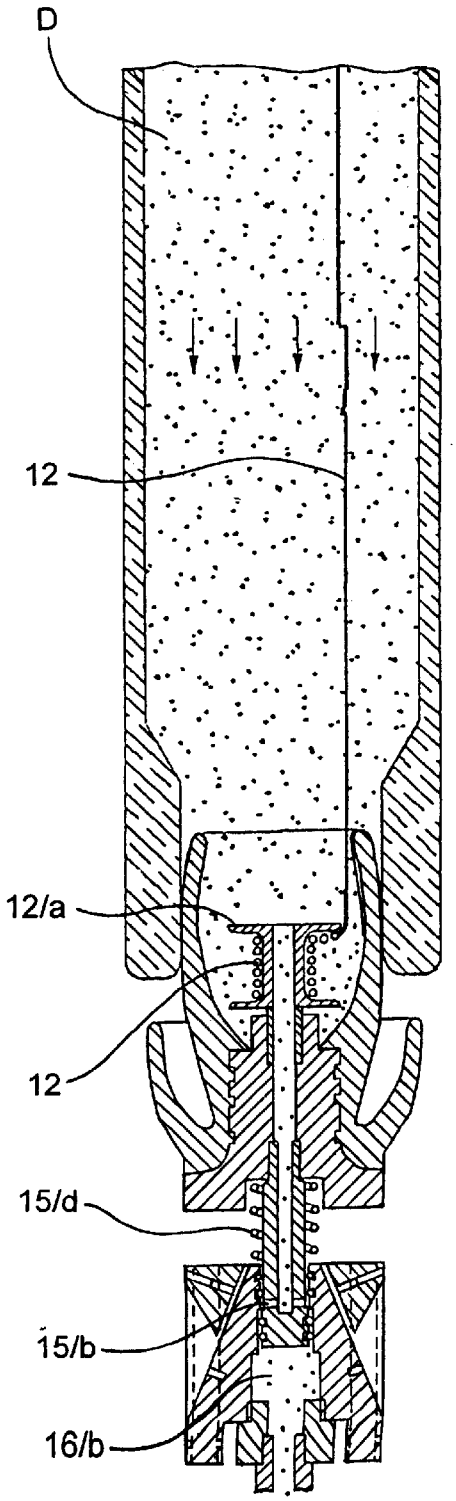
FIG. 8-D

DEVICE FOR PLUGGING HORIZONTAL OR VERTICAL WELLS IN OIL OR SIMILAR DRILLINGS

This is a continuation-in-part application of U.S. application Ser. No. 08/574,114 filed Dec. 18, 1995.

FIELD OF THE INVENTION

The main object of the present invention is a device for plugging horizontal or vertical wells in oil or similar drillings where drilling is necessary.

More specifically, the present invention concerns a device which, being liable to be placed at a predetermined depth, is operated by simple hydraulic inflation, and becomes a plug that assures efficient, safe sealing, avoiding bydraulic communication between strata traversed by drilling, be it horizontal or vertical.

PRIOR ART

The fluid column filling the well is very important throughout the drilling process and during the completion of the well, after pipe setting and during its productive life, and even after its productive life is over.

The absence of fluids and/or a deficient column may cause problems of such magnitude that they can interfere with productive life, and even lead to the total loss of the well, increasing, in these cases, the risks and hazards implied by uncontrolled blows. Attending to these problems and fixing these shortcomings involves extremely difficult and hazardous work.

There are various chemical or mechanical methods used to plug wells, be they open or piped. A chemical solution is generally applied by injecting fluids into the well that can solidify, generally by setting with cement or catalyzing with polymers. These elements, after setting, withstand pressure in leaking areas and, after becoming solid, permit a new drilling so that work may continue. In order to place such setting liquids both in open and piped wells, it is absolutely necessary for the fluid column to have sufficient support so as to maintain and offset the pressure produced by the liquid plug balanced in the column, which is heavier than the entire fluid making up the column.

In the event of entry in the lower layers, a packing element must be emplaced to interrupt hydraulic communication, and therefore prevent entry to the fractured statum which has no hydraulic support.

Currently available elements resort to mechanical packing, and work by tension or weight. They are limited by their low packing ability and uncontrolled movement, relative to the distance needed to produce their effect. This method is almost totally discarded in drifted or horizontal wells.

Consequently, the inflatable packings available today are totally limited by their low support margin and the impossibility of placing, more than one seal per trip, also known as a stroke, down the well, due to operating difficulties, as well as extremely high cost.

It is noteworthy that in abandonments, whether temporary or permanent, of areas or wells no longer of economic interest, the methods used must comply with current ecological standards, with high, unrecoverable investment costs.

Currently, the only methods and elements available for the fixing and closing of wells require work or investment programs just as costly as those required for starting up production in a high yield well.

The device of the present invention offers a specific answer to this paradoxical situation.

OBJECTS OF THE INVENTION

The use of the device of the present invention offers considerable advantages over current methodologies. Indeed, it can interrupt hydraulic communication downwards or upwards, in open or piped wells, affording efficacious support to the fluid column injected on top. One or more packing elements may be placed at predetermined depths, depending on operating needs and, thus, they allow working in wells devoid of fluid; in the absence of a hydrostatic column, as well as in almost all wells declared unproductive for more than ten years and therefore requiring permanent abandonment at low cost, in keeping with current ecological and environmental standards.

SUMMARY OF THE INVENTION

These advantages, indicated summarily, are the direct consequence of the special combination of means making up the device of the present invention which basically includes the use of packing plugs proper, and the use of a special stopper used to descend and work with one or several packing plugs, which operate by simple inflation, such as fluid compression, with any type of fluid, such as cement, water, test fluid, drilling mud, etc.

Each plug is made up of an elastic element that can expand laterally and which, when injected with liquid, is deformed concentrically. Longitudinal stretching is limited by longitudinal reinforcements placed inside the elastomer. In addition, it is equipped with non-metallic reinforcements at its ends, vulcanized and placed so as to make up the front and rear reinforced shoulders, allowing only transverse stretching for total obstruction of the drilling.

The metallic tip of the plug is placed at its rear end, threaded onto a secondary valve, which complements the main valve, after the plug is inflated and packed.

The special design and composition of the parts allow simple, safe operation, provided the butt end is placed in the seat of the stopper, which will be attached to the casing.

After the plug is placed in the seat of the stopper, by pressure, the cup is displaced towards its main valve, cutting the locks of the ejection stems. The springs of the stems are decompressed, ejecting the packing element and opening the main valve, letting compressed fluid enter into the inflatable chamber.

When the plug is placed outside the conductor casing, the assembly is ready for final inflation, letting the compressed fluid pass through the main valve and through a flexible tube to the expandable chamber, inflating and stretching the lateral contour, and so packing the assembly against the wall of the well. Inflation pressure is regulated by the main locks which, when cut, allow the retraction of the seat latches and, consequently, the displacement of the sub-assembly of the valve outside the element that carries it, such as the stopper.

When more than one element must be used, the stopper is loaded and the first element is lowered outside the plug-carrying tube, joined to the remaining plugs placed in the plug-carrying tube, by means of a turnbuckle. When pressure is increased from the surface, it acts on the cup with a piston-like effect, displacing the assembly until it presses the latches against the seat of the stopper and produces the action described above. With the plug kept in place by packing, the required fluids are injected. When the pipes, and therefore the stopper are raised, the turnbuckle, joined to the plug or the element previously packed, pulls out the following plug found in the plug-carrying tube, and places it in the seat of the stopper, thus allowing its placement according to the mechanism described above, which will be repeated as many times as there are elements to install.

With the aforementioned stopper, more than one plug may be placed, i.e. as many as the stopper can contain, introducing the setting fluid between the plugs in a single stroke, and from bottom to top. The lengths and diameters to pack can be adapted to a wide range of operating needs, both for open non-piped wells and piped wells, inside the tubing, which makes it quite versatile and adapted to find a wide field of application.

By varying the diameters and maintaining the operating valve system, the device of the present invention can be used as a packer for tubes with various diameters, as required for the operation at hand.

By adding a rotary pump above the system, the elements can be inflated without need to circulate inflation fluid in the casing.

The elastomer can be reinforced with iron straps, to allow higher working pressures, and abrasive elements can be added to increase the support capability of the plug as compared to the well or casing.

These alternatives make possible low operating costs for the tasks related to the abandonment of old wells, due to the possibility of anchoring the cement inside the abandoned wells, although they have no fluid inside. In this manner, the user avoids the need to install the large equipment necessary for the installation of conventional mechanical or hydraulic plugs required for this task, such as in permanent abandonment, placing cement at large intervals, such as in conjunction with well perforation, in order to permanently plug the artificial communication between permeable layers, and preventing and correcting the undesirable environmental impact that unproductive wells may cause when not correctly abandoned.

OPERATION OF THE INVENTION

The present invention is a device which operates to plug horizontal or vertical wells in oil or similar drillings. The device can be introduced to predetermined depths, becoming a part of the piping. It is operated by hydraulic inflation, and is of a non-recoverable type.

The device includes one or more elastic packing elements which are radially expandable by inflating. Each elastic packing element is equipped with a tip at its rear end. The tip is connected to a flexible tube extending to a main body, which includes a double valve assembly, including a primary valve and a secondary valve.

The valve assembly allows for the access of fluid through the flexible tube to an interior of the elastic packing element. The valve assembly has one or more elastic cups which lead the fluid towards an interior of the valve assembly. The assembly includes a stopper having an inclined plane.

The main body of the device is equipped with at least one cutting member that regulates inflation pressure by cutting. The cutting member is connected to latches sliding on an inclined plane in the main body.

Therefore, the elastic packing element is connected to the main body by an expansion element supported by a rigid joint member, which is joined to the main body through at least one secondary cutting lock.

The device also includes an element for supplying fluid under pressure to the main body, to cause the latches to engage the inclined plane. This action causes the secondary cutting lock to disengage, thus releasing the packing element from the main body and opening the secondary valve, to permit the fluid to inflate the packing element which is transported and operated by a carrying stopper.

A turnbuckle wire unwinds as the main body goes down the device, and then it breaks apart, separating when the main body is retracted.

It is further noted that while water is the preferable fluid, other fluids or gases may be used to inflate the packing element.

DESCRIPTION OF THE DRAWINGS

In order to illustrate the advantages summarily described, to which users and professionals may add many others, and in order to facilitate the comprehension of the constructive, constitutive and functional characteristics of the device of the present invention, there is described below an example of realization of the present invention, as illustrated in the enclosed drawings, with the express clarification that, since this is an example, the scope of the protection of this invention is not limited or exclusively related thereto.

Figure No. 1 is a longitudinal cross section showing a whole plugging device, such as a plugs-stopper, descending to operating position.

Figure 1:
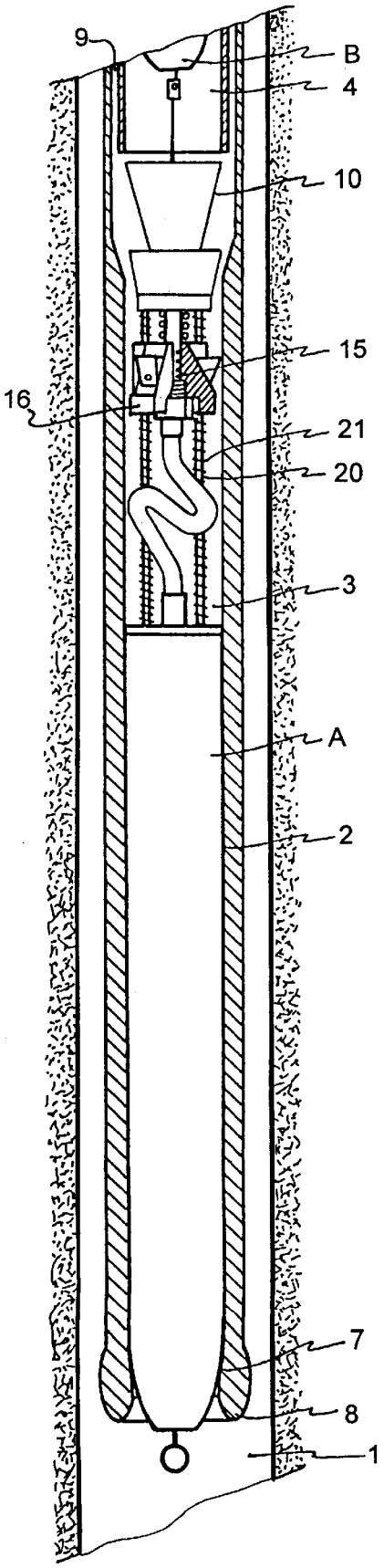

Figure No. 2 is a longitudinal cross section of an enlarged detail of the main valve in operating position, with all its elements.

Figure No. 3 shows, also in longitudinal, partial and schematic cross section, the inflatable element displaced from the main assembly.

Figure No. 4 is a representation of the same elements illustrated in the previous figures, with an inflatable element expanded towards the walls of the well.

Figure No. 5 is a cross section of the main assembly, showing the turnbuckle separated from the stopper.

Figure No. 6 shows a second assembly, positioned, after fluid is injected and the tubes ascend with the stopper in the new operating position.

Figure No. 7 is a longitudinal cross section showing the well after the whole operation is completed, using three elements in this case.

Figure No. 8A is a cross sectional view of the valve assembly showing the sliding of one of the elements.

FIG. 8B is a cross sectional view of the valve assembly showing the injected fluid moving in the valve assembly.

FIG. 8C is a cross sectional view of the valve assembly showing the cutting of seals to move latches to move the main body therein.

FIG. 8D is a cross sectional view showing the valve assembly in a closed position.

DETAILED DESCRIPTION OF THE DRAWINGS

It is noted that in all the drawing figures, the same reference numbers and letters correspond to the same or equivalent parts or elements of the whole, according to the example selected for this explanation of the plugging device of the present invention.

As can be seen in FIG. 1, the device, such as the plug and stopper, moves inside a well -1-, where one can see packing element -A- located inside stopper -2- which occupies the space in compression chamber -3- of stopper -2-. Above chamber -3- can be seen the end of carrying casing -4-, as well as the end of second packing element -B-.

The packing elements descend, in repose position.

Stopper -2-, at its upper end, is attached by threaded joints -5- to casing -6-, to form a continuous assembly from the surface.

Stopper -2- is completed with an operating seat -7-located after the end or nozzle -8-.

Between the body of stopper -2- and carrying casing -4-there there is provided circulation space -9- which allows the passage of the fluid and/or pressure towards the packing assembly located in compression chamber -3-.

Figure 2:
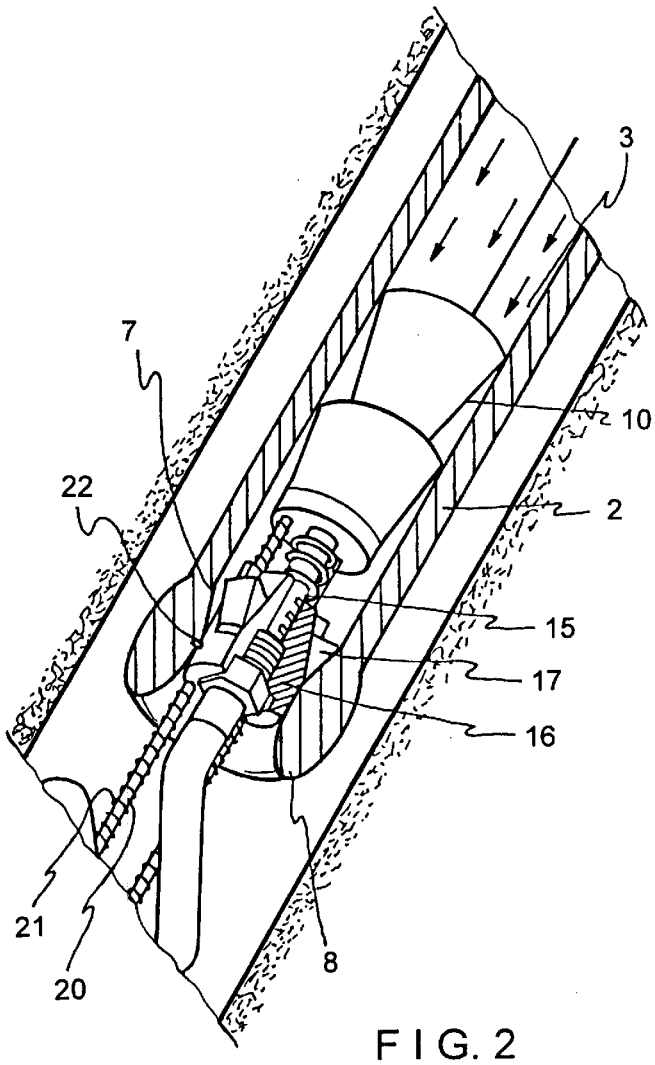

In FIG. 1 and in details shown in FIG. 2, there can be seen the components making up each packing element -A-, -B-, -C-, -D-, as the case may be. In the detail view in. Figure. No. 2, it can be seen that cup -10- is displaced under pressure until sliding latches -17- are placed in seat -7- of stopper -2-. There is also shown stem assembly -15- and valve body -16- barring the passage to the pressure induced from the surface. Secondary fusibles -22- prevent the displacement of stems -20- and the subsequent expansion of spring -21-.

Figure 3:
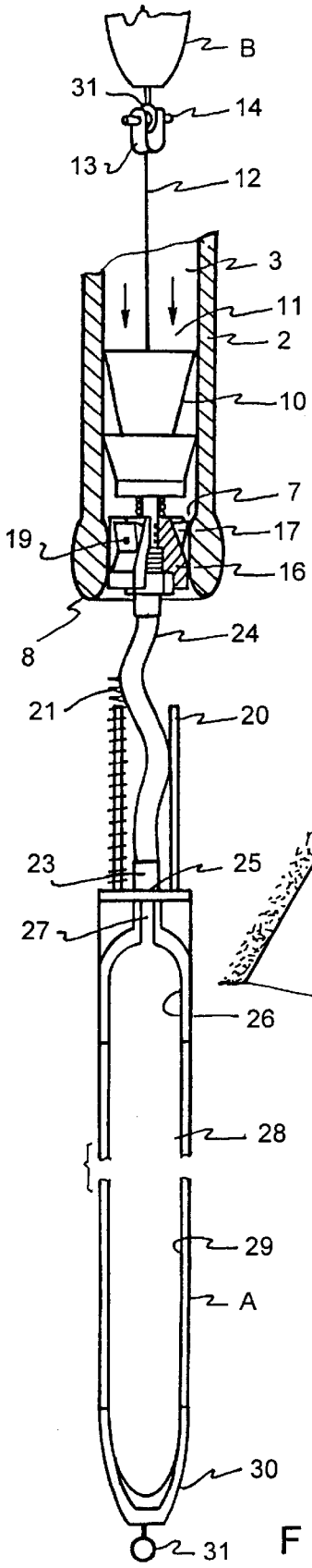

As can be seen in FIG. 3, by action of the induced pressure, sliding latches -17-, supported by main cut outs -19-, make it possible for elastic cup -10- to move from main body -16- of the valve, sliding stems -20- and cutting secondary cut outs -22-, freeing the tension of springs -21- and separating the packing assembly, stems -20- and springs -21- from the main body of valve -16- and of nozzle -8- of stopper -2-, as permitted by the length of flexible tube -24-.

Figure 4:
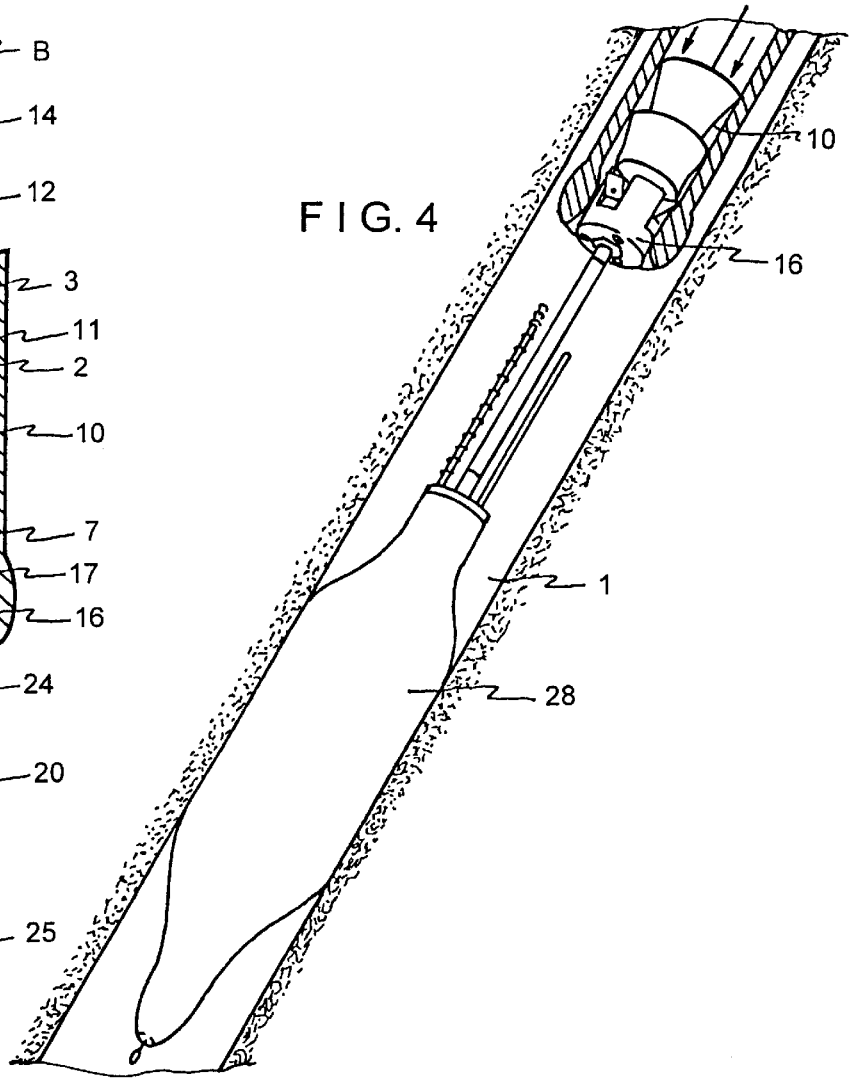

Now observing FIG. 4, there is shown the structure of the assembly with the packing element fully plugging the interior of well -1-. Elastic cup -10-, displaced towards the main body of valve -16-, allows the admission of the fluid into inflation chamber -28-, which expands and fully plugs the space of well -1-.

Figure 5:
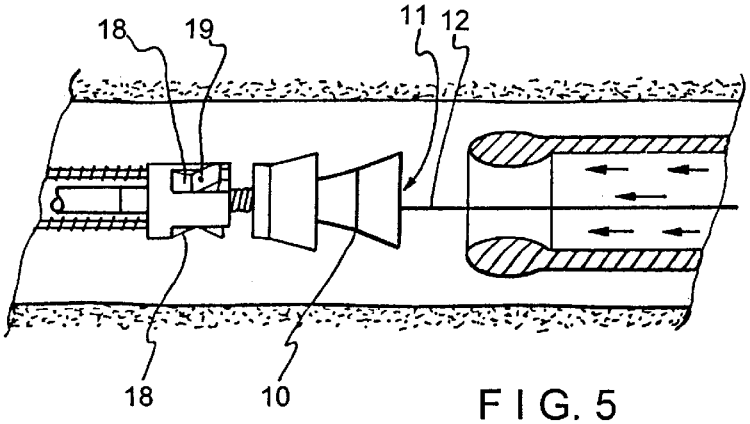

The compressed fluid, in its pushing action exerted on cup -10- produces the breakage, by cutting, of main cut outs -19-, and the sliding of the latches on the inclined plane of body -19-, allowing the free passage of the entire assembly, as can be seen in FIG. 5. Thereafter, turnbuckle -12-connects with assembly -B-, which is still located in carrying casing -4-.

Figure 6:
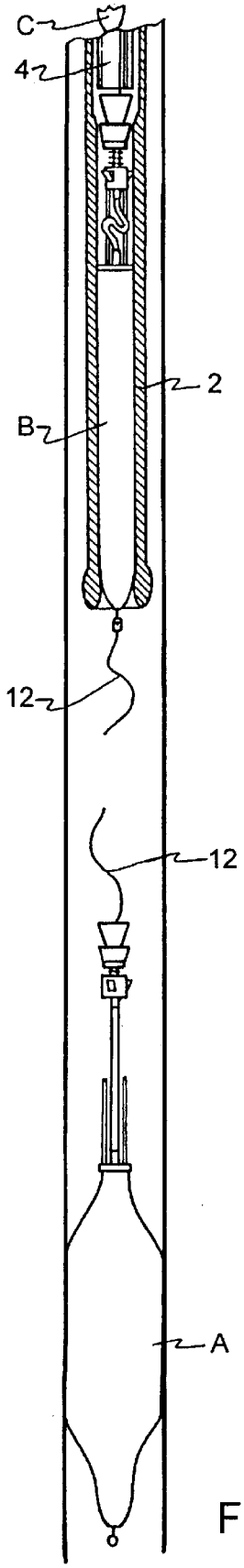

In the longitudinal cross section of FIG. 6, there is shown part of assembly -A- already packed. Turnbuckle -12- is released from assembly -B-. Stopper -2- is shown already totally separated from packed assembly -A-, and assembly -B- in an operating position, provided fluid is injected from the surface, at controlled pressure, to repeat the functional arrangement described in the previous figures.

Figure 7:
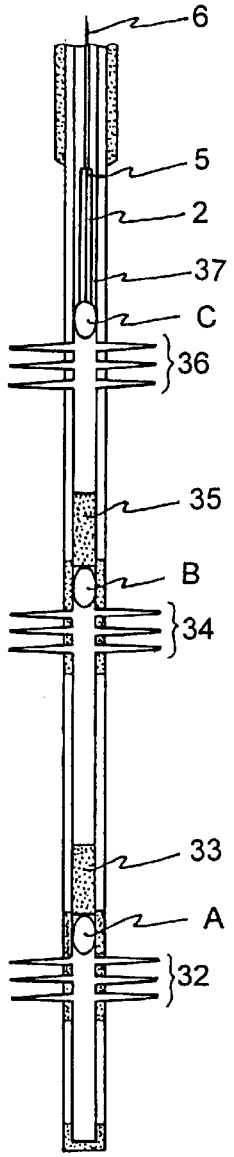

FIG. 7 represents a longitudinal cross section of a well with its entry zone -32- plugged by element -A-, after injection of setting column -33- on top of the latter. The secondary inlet of perforation -34- is plugged by packing element -B- and setting column -35-. The same occurs in perforation zone -36- with packing element -C- and stopper 2 in position for injecting a third setting column -37-, not yet performed, injected through casing -6-, coupled to stopper -2- by threaded joint -5-.

FIG. 8A shows the valve assembly of one of the elements sliding in the compression chamber 3 through the pushing action of the activation fluid D, which when injected from the surface allows the elastic cup 10 to act as a piston inside the chamber 3. The sliding latches 17 are not yet set in the seats 7 and both the main cut fuses 19, which support the latches 17, and the secondary fuses 22, which support the rods 20, are in one piece, while the spring 21 is compressed and the member 16*d* remains expanded. The hydraulic communication orifice formed by elements 11*b*, 10*b* and 15*a* is interrupted at the outlet of the transverse orifices 15*b* by the action of the hydraulic seals 15*c* and 16*a*.

FIG. 8B shows that the pressure induced by the injected fluid D moves the valve assembly inside the chamber 3 until the latches 17 rest in seat 7 and the pressure exerted by the fluid 3 on the elastic cup 10 causes the rods 20 to cut the fuses 22, thus releasing the energy accumulated in the springs 21 separating the packing element (A-B or C) from the valve body, to which it is attached by the elastic conduit 24. The valve rod 15 shifts from the valve body 16 opening the passage 15*b* to the chamber 16*b* to communicate through the conduit orifice 24*a* to the elastic chamber 28 of the packing element (A-B or C) until the main fuses of the latches 19 are broken by the pushing action generated by injected fluid D on the cup 10.

FIG. 8C shows that when the pushing action of the pressurized fluid D causes the cutting of the main seals 19, the latches 17 are moved along the inclined plane 18, allowing the passage of the valve body 16 through the inside of the mouthpiece 8 of the casing 2 and the subsequent expansion of the spring 16*d* to shut off the passage 15*b* of the compressed fluid to the chamber 28. The elastic cup 10 retracts to come out through the mouthpiece 8. The linking tensioning device 12 can be seen coming out of the spool 12*a* thus keeping the linkage with the packing element immediately above.

FIG. 8D shows that the injected fluid D in its pushing action removes the cup 10 from the casing 2, releasing it completely from it. The tensioning device 12 is its only linkage with the casing immediately above. The valve assembly formed by the rod 15 and the body 16 remains closed by the action of the spring 15*d* with respect to the chamber 16*b* and the conduit 24*a*. After the injection of the setting fluid, the casing 2 is lifted to position it in the place of the next fixing, extracting in its stroke of the spool 12*a* the whole tensioning device 12, to position the next element (B or C) inside the casing 2 until the tensioning device 12 is cut by traction.

The link 22 is broken in the following manner:

As observed in FIGS. 1, 2 and 8A the secondary fusibles 22 hold stems 20 fixed to the body of valve 16 supporting the displacement action produced by springs 21.

FIG. 3 of the original description and FIGS. 8B, 8C and 8D show secondary cut outs 22 broken, leaving one part inside stem 20 and the other in the body of valve 16.

It can be observed that the action of pression on fluid D displaces the elastic cup 10 which caused the metallic body 10A to slide stems 20 in its pushing, breaking the secondary cut outs 22, allowing the expanison of springs 21 and displacing the assembly of packing element 28 with stems 20 and springs 21 outside stopper 2, while the body of valve 16 remains connected to inflation chamber 28 by the flexible tube 24.

The tensioning device 12 is broken as follows:

FIGS. 1 to 5 show assemblies A and B united by turnbuckle 12. In FIG. 6 is shown stopper 2 placed in the upper part ready to operate the assembly B. The turnbuckle 12 is cut by the traction action of stopper 2 in its way up with respect to assembly A anchored to the walls of well 1. When the turnbuckle 12 stretches to the maximum during the movement of the stopper 2 on its way up, it slides assembly B to locate it in the actioning position observed in FIG. 6.

While turnbuckle 12 continues climbing stopper 2, the turnbuckle 12 gets cut, separating assembly A from the rest of the elements (stopper 2 with assemblies B and C).

It is further noted that other modifications may be made to the present invention, without departing from the spirit and scope of the present invention, as noted in the appended claims.

I claim:

1. A device for plugging horizontal or vertical wells in oil or similar drillings, which device can be introduced to predetermined depths, becoming a part of the piping normally associated with said drillings, operated by hydraulic inflation, and being of a non-recoverable type, said device comprising:

at least one elastic packing element, radially expandable by inflating, said at least one elastic packing element equipped with a tip at its rear end, said tip connected to a flexible tube extending to a main body, which said main body has an inclined plane and includes double valve assembly means including a primary valve and a secondary valve, said valve assembly allowing the access of fluid through said flexible tube to an interior of said elastic packing element and having at least one elastic cup which leads the fluid towards an interior of said valve assembly means, said main body being equipped with at least one cutting means connected to latches sliding on said inclined plane, said elastic packing element being connected to the main body by an expansion element supported by a rigid member joined to the main body through at least one secondary cutting lock, means for supplying fluid under pressure to said main body causing said latches to engage said incline plane, causing said secondary cutting lock to disengage, releasing said packing element from said main body and opening said secondary valve to permit said fluid to inflate said packing element, and a carrying stopper which transports and operates said at least one elastic packing element.

2. The device for well plugging, according to claim 1, wherein said at least one elastic packing element has reinforcements which limit axial stretching.

3. The device for well plugging, according to claim 1, wherein said at least one elastic packing element, at its front and rear ends, includes reinforcements, as well as extensible bands, joined by vulcanization for defining said at least one packing element within the walls of the well.

4. The device for well plugging, according to claim 1, wherein said at least one elastic packing element is equipped with a secondary check valve.

5. The device for well plugging, according to claim 1, wherein a plurality of axial inflation spillways are provided inside an expandible elastic wall of said at least one elastic packing element.

6. The device for well plugging, according to claim 3 wherein a front reinforcement member is joined to said plurality of axial inflation spillways.

7. The device for well plugging, according to claim 3, wherein a rear reinforcement member is joined to said plurality of axial inflation spillways.

8. The device for well plugging, according to claim 1, wherein said inflation tip is part of a rear reinforcement of said at least one elastic packing element.

9. The device for well plugging, according to claim 1, wherein said secondary valve is placed at a tip of said at least one elastic packing element.

10. The device for well plugging, according to claim 1, wherein said flexible tube is introduced between said primary valve and said secondary valve.

11. The device for well plugging, according to claim 1, wherein said at least one secondary cutting lock is a bolt.

12. The device for well plugging, according to claim 3, wherein said interior reinforcements of said elastic packing element conform in shape with the final shape of said at least one elastic packing element.

13. The device for well plugging, according to claim 1, wherein said main valve is placed in said main body.

14. The device for well plugging, according to claim 1, wherein said body of said main valve is located, so as to move from said main body to release said at least one elastic packing element and allow said at least one elastic packing element to be inflated within the interior of the well.

15. The device for well plugging, according to claim 1, wherein said main lock is released by cutting said tubular element carrying said main lock.

16. The device for well plugging according to claim 1, wherein pressure is communicated to said inflation chamber through said flexible tube.

17. The device for well plugging, according to claim 1, wherein said cutting means comprises a plurality of cut out cutting bolts regulating the operation of said device.

18. The device for well plugging, according to claim 1, wherein the cutting tension supporting each said cut out cutting bolt comprises a predetermined tension.

19. The device for well plugging, according to claim 1, wherein said at least one elastic packing element is introduced into the well by drilling.

20. The device for well plugging, according to claim 1, wherein said carrying stopper is joined with said tubing.

21. The device for well plugging, according to claim 1, wherein said elements are placed in operating-position in said stopper by action of a positioning cord.

22. The device for well plugging, according to claim 1, wherein inflation pressure is regulated by the cutting tension of said main cut out cutting bolts.

23. The device for well plugging, according to claim 1, wherein the cutting tension supporting said secondary cut outs are lower than those admitted for said main cut outs.

24. The device for well plugging, according to claim 1 further comprising a tensioning device disposed below said elastic packing element.

25. The device for well plugging, according to claim 1, wherein said elastic cup supports the assembly inside the said stopper.

26. The device for well plugging, according to claim 1, wherein said elastic cup includes a shape adaptable to the various diameters of said stopper.

27. The device for well plugging, according to claim 1, wherein said expansion means comprising a compression spring which releases the system and leaves a space for operation.

28. The device for well plugging, according to claim 1, further comprising a spring wherein the said second cutting lock is arranged to maintain said spring.

29. The device for well plugging, according to claim 1, wherein the cutting of said secondary lock allows the expansion of (said spring), which pushes at least one stem forming a rigid connection element.

30. The device for well plugging, according to claim 28, further comprising a rigid connection element joined to said main assembly, wherein said rigid connection element is arranged and constructed to remain joined to the main assembly while said spring is compressed.

31. The device for well plugging, according to claim 30, wherein said rigid connection element includes at least one stem which contains a folded flexible tube, while joined to said main assembly.

32. The device for well plugging, according to claim 31, wherein said flexible tube stretches when said joint element is released.

33. The device for well plugging, according to claim 31, wherein (said flexible tube) is attached to said secondary valve by a threaded joint.

34. The device for well plugging, according to claim 31, wherein (said flexible tube) is attached to said main body by a threaded joint.

35. The device for well plugging, according to claim 1, wherein the elements used with said stopper are equipped with a positioning cord.

36. The device for well plugging, according to claim 1, wherein said at least one elastic packing element includes radial stretching walls which are more elastic than reinforced ends of said at least one elastic packing element.

37. The device for well plugging, according to claim 31 wherein said main body has a displacement hole for said at least one stem.

38. The device for well plugging, according to claim 1, further comprising main lock bolts and secondary lock bolts, wherein said main body supports said main lock bolts and said secondary lock bolts.

39. The device for well plugging, according to claim 31, wherein said secondary cutting lock is linked to said least one stem.

40. The device for well plugging, according to claim 1, wherein in the front end of said at least one elastic packing element includes reinforcements which are joined by vulcanization.

41. The device for well plugging, according to claim 1, wherein on the rear end of said at least one elastic packing element includes reinforcements which are joined by vulcanization.

42. The device for well plugging, according to claim 1, wherein the length of said at least one elastic packing element varies depending on operating requirements.

43. The device for well plugging, according to claim 1, wherein said at least one elastic packing element moves within a chamber made watertight by at least one elastic toroidal joint.

* * * * *